US008753001B2

(12) United States Patent
Schauerte et al.

(10) Patent No.: US 8,753,001 B2
(45) Date of Patent: Jun. 17, 2014

(54) METERING APPARATUS AND METHOD FOR INTRODUCING A POWDERY MEDIUM INTO A FLUID

(75) Inventors: Manfred Schauerte, Schmallenberg (DE); Markus Hamers, Lennestadt (DE); Meinolf Rameil, Lennestadt (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 71 days.

(21) Appl. No.: 13/375,323

(22) PCT Filed: May 27, 2010

(86) PCT No.: PCT/EP2010/003224

§ 371 (c)(1),
(2), (4) Date: Feb. 27, 2012

(87) PCT Pub. No.: WO2010/139418

PCT Pub. Date: Dec. 9, 2010

(65) Prior Publication Data

US 2012/0170402 A1 Jul. 5, 2012

(30) Foreign Application Priority Data

May 30, 2009 (DE) ..... 10 2009 023 546

(51) Int. Cl.
*B28C 5/08* (2006.01)

(52) U.S. Cl.
USPC ..... 366/67; 366/65

(58) Field of Classification Search
CPC .... B28C 5/4282; B28C 5/4286; B28C 5/163; B01F 7/00158; B01F 7/00208
USPC ..... 366/20, 50, 9, 133, 21
See application file for complete search history.

(56) References Cited

U.S. PATENT DOCUMENTS

| | | | | |
|---|---|---|---|---|
| 1,486,883 | A | 3/1924 | Palmer | |
| 2,230,880 | A * | 2/1941 | Brown | 366/50 |
| 3,515,156 | A | 6/1970 | Schuh | |
| 3,881,656 | A | 5/1975 | Markfelt et al. | |
| 4,007,921 | A | 2/1977 | Zingg | |
| 4,117,547 | A * | 9/1978 | Mathis et al. | 366/20 |
| 4,359,151 | A * | 11/1982 | Fyie et al. | 198/525 |
| 4,430,001 | A | 2/1984 | Schurr | |
| 5,344,619 | A | 9/1994 | Larwick et al. | |
| 5,520,457 | A * | 5/1996 | Gontero et al. | 366/230 |
| 6,305,835 | B1 | 10/2001 | Farrar et al. | |
| 2006/0120214 | A1 * | 6/2006 | Raftis | 366/165.2 |
| 2007/0240907 | A1 | 10/2007 | Schauerte et al. | |
| 2008/0041449 | A1 * | 2/2008 | Schauerte | 137/7 |
| 2009/0261310 | A1 | 10/2009 | Schauerte et al. | |

FOREIGN PATENT DOCUMENTS

| | | |
|---|---|---|
| DE | 14 57 815 C | 3/1969 |
| DE | 19 30 235 A | 12/1970 |
| DE | 86 30 501 U1 | 5/1988 |
| DE | 199 18 775 B4 | 4/2000 |

(Continued)

*Primary Examiner* — Tony G Soohoo
*Assistant Examiner* — Anshu Bhatia
(74) *Attorney, Agent, or Firm* — Henry M. Feiereisen LLC

(57) ABSTRACT

The application relates to a metering apparatus for introducing a powdery medium into a fluid, comprising a guide device for guiding the fluid and a metering device, said metering device being arranged above the guide device such that the powdery medium released by the metering unit is scattered onto the surface of the fluid.

10 Claims, 6 Drawing Sheets

(56) References Cited

FOREIGN PATENT DOCUMENTS

| | | | |
|---|---|---|---|
| EP | 0 122 264 | B2 | 10/1984 |
| EP | 0 488 666 | A1 | 6/1992 |
| WO | WO84/01526 | | 4/1984 |
| WO | WO 2009/154468 | A1 | 12/2009 |

* cited by examiner

METERING APPARATUS AND METHOD FOR INTRODUCING A POWDERY MEDIUM INTO A FLUID

CROSS-REFERENCES TO RELATED APPLICATIONS

This application is the U.S. National Stage of International Application No. PCT/EP2010/003224, filed May 27, 2010, which designated the United States and has been published as International Publication No. WO 2010/139418 and which claims the priority of German Patent Application, Serial No. 10 2009 023 546.9, filed May 30, 2009, pursuant to 35 U.S.C. 119(a)-(d).

BACKGROUND OF THE INVENTION

The invention relates to a metering apparatus for introducing a powdery medium into a liquid fluid. The invention also relates to a mixing system with a metering apparatus of this type for mixing a drilling fluid, as well as a method for introducing a powdery medium into a liquid fluid.

It is known to use a drilling fluid for supporting the drill feed when constructing ground drill holes and in particular horizontal drill holes. The drilling fluid is used to soften the ground in advance of the drill head of the drilling apparatus in order to improve the cutting performance of the drill head. The drilling fluid can also be used to lubricate the drill head and the drill rods, which are rotatably driven in the drill hole, so as to reduce friction with the ground. In addition, the drilling fluid can be used to flush out the soil removed by the drill head through the annular gap between the drill rod and the wall of the drill hole or through an annular gap of dual drill rods.

The drilling fluid is typically a mixture of water and bentonite, and sometimes several additives. Bentonite is a mixture of different clay materials, with the largest component being montmorillonite (generally with a content of 60% to 80%). Additional accompanying materials may be quartz, mica, feldspar, pyrite and sometimes also calcite. Due to the montmorillonite content, bentonite has strong water absorption and swelling capability.

Water into which bentonite is stirred can have thixotropic characteristics, so that it behaves like a fluid when in motion, but like a solid structure when at rest. Because of this behavior, a drilling fluid composed of water and bentonite can also be used for supporting the wall of the drill hole, thereby preventing a collapse.

The introduction of bentonite into water poses a particular challenge, because the bentonite has the tendency to lump together in contact with water. In the state-of-the-art, the drilling fluid is typically stirred in large storage vessels with dynamic mixing apparatuses and thereafter transported in batches to the construction site where the drilling fluid is to be used. However, such batch-wise mixing is quite cumbersome. In addition, after the drill hole has been completed, the unused portion of the last batch must be disposed of, which is complex and expensive.

Another conventional method and a corresponding mixing apparatus are known, which eliminate this disadvantage of batch-mixing of a drilling fluid. With this approach, the bentonite is introduced directly in the water in the region of a high-pressure pump, which is provided for transporting the drilling fluid through the drill rod to the drill head of a horizontal drilling apparatus, in order to take advantage of the turbulences produced in the water by the high-pressure pump for mixing the bentonite with the water. A swelling section can be arranged downstream of the high-pressure pump, where the bentonite-water-mixture is given time to swell before it is transported through the drill rod to the drill head.

Such method for continuous mixing of a drilling fluid and a corresponding continuous flow mixing system are disclosed in DE 199 18 775 B4. However, this document does not disclose the manner in which the powdery bentonite is actually introduced into the water.

Starting from the aforedescribed state-of-the-art, it was an object of the invention to provide an improved metering apparatus for introducing a powdery medium into a fluid, with which the problem associated with the powdery medium lumping together upon contact with the fluid, known from the state-of-the-art, can at least be reduced. According to the invention, a corresponding method and a mixing system for mixing a drilling fluid will also be described.

SUMMARY OF THE INVENTION

This object is attained with a metering apparatus for introducing a powdery medium into a fluid, which includes a housing, a guide device for guiding the fluid and forming a continuous flow of the fluid in the housing, wherein the fluid has a fluid surface, and a metering device arranged above the guide device and dispensing the powdery medium. The metering device is constructed to scatter the powdery medium onto the fluid surface. The obiect is also attained with a method for introducing a powdery medium into a fluid, with the steps of providing a continuous flow of the fluid. forming a fluid surface from a fluid film guided inside a housing, metering the powdery medium, and scattering the metered powdery medium onto the fluid surface by gravity. The obiect is further attained with mixing system for mixing a drilling fluid, which includes the claimed metering apparatus, a bentonite feed operatively connected with the metering device, a water feed operatively connected with the guide device, and a pump.

The core of the invention is directed to improving mixing of the powdery medium with the fluid by scattering the powdery medium onto the surface of the fluid in a metered form. Scattering the powdery medium onto the surface of the fluid results in a fine distribution of the individual particles of the powdery medium already at the time of the first contact with the fluid, thereby effectively preventing lumping.

In the context of the invention, "scattering" refers to dispensing the particles of the powdery medium from the metering device and/or applying the powdery medium on the fluid surface as finely distributed as possible. Scattering according to the invention can occur through gravity; however, pressure-aided dispensing, for example in conjunction with compressed air or other auxiliary means for accelerating a particle may also be included in the term "scattering" according to the invention. However, a combination of gravity-fed and pressure-aided scattering is also feasible.

A particularly fine distribution of the powdery medium on the fluid surface can be achieved with a continuous flow of the fluid through the guide device, as is the case, for example, in a continuous flow mixing apparatus for producing a drilling fluid.

According to the invention, the distribution of the powdery medium in the fluid can advantageously be further improved by designing the guide device below the metering unit so that a fluid film is created with a width that is a multiple of its depth. With this configuration of the metering apparatus according to the invention, the powdery medium can already be so finely distributed on or in the fluid that complex mixing with static or dynamic mixing units may no longer be necessary.

Advantageously, the metering apparatus according to the invention may be provided with a pump; this particularly applies when a metering apparatus according to the invention is integrated in a continuous flow mixing system for a drilling fluid, wherein a pump is typically already installed for transporting the mixed drilling fluid through a drill pipe to a drill head.

According to the invention, the metering device may form a metering gap, with which the powdery medium can be distributed over a large-area on the fluid surface. With the metering apparatus according to the invention, the metering gap may advantageously have a length which corresponds substantially to the width of the guide device. The powdery medium can thus be scattered according to the invention over the entire surface of the fluid film.

In a preferred embodiment of the metering apparatus according to the invention, the metering gap may be formed by a (first) metering roller and a corresponding counter element. By providing a metering roller, the powdery medium can be continuously dispensed even if the metering gap is very small; the metering roller(s) may dissolve lumps of the powdery medium, thereby preventing clogging of the metering gap. With the rotating motion of the metering roller, a fine film of the powdery medium can be formed and pushed through the metering gap. This may cause the film of the powdery medium to adhere to the surface of the metering roller. The metering roller may have a suitably formed (e.g. roughened) surface which aids a continuous formation of a film of the powdery medium on the surface of the metering roller.

To detach a film of the powdery medium adhering to the surface of the metering roller, so that this film may be scattered according to the invention on the fluid surface, the film may be detached from the surface of the metering roller with a stripping element.

In another preferred embodiment of the metering apparatus according to the invention, the counter element may also be constructed as a (second) metering roller. In this way, a particularly fine film of a powdery medium can be obtained on the surface of one or both metering rollers. This applies particularly to the preferred embodiment of the metering apparatus according to the invention, wherein the two metering rollers are driven for rotation in the same direction, forming opposing tangential velocity components in the metering gap.

In another embodiment, the metering gap may be formed by two plates facing each other, preferably with a conical orientation. The two conically oriented opposing plates may form an intermediate reservoir in form of a funnel and thus enable very finely metered dispensing of the powdery medium, which can then be scattered on the fluid surface.

Clogging of the metering gap formed by the plates by lumps that may be present in the powdery medium can be prevented by moving the plates cyclically with a drive in opposing directions. The finely metered powdery medium can then be continuously dispensed. The direction of the cyclical relative movement of the two plates may preferably be parallel to the gap, because the gap width is then not changed in spite of the relative movement of the flaps. However, it will be understood that other movement directions are also feasible.

According to another preferred embodiment of the metering apparatus according to the invention, a metering brush may be provided to further separate and, if desired, also accelerate the particles of the powdery medium. In particular, the metering brush may be constructed as a roller, with a rotation of the roller-shaped metering brush enabling a continuous motion. For example, the metering brush may be provided to brush off a film of the powdery medium formed on a metering roller, whereby the particles are scattered in finely metered form on the liquid surface.

In a preferred embodiment of the metering apparatus according to the invention, the powdery medium may be supplied to the metering device with a feed screw. It will be understood that other feed devices may also be used, for example a funnel, through which the powdery medium can be gravity-fed to the metering device.

The metering apparatus according to the invention is particularly suited for introducing bentonite into an aqueous fluid and in particular into (pure) water.

The method according to the invention for introducing a powdery medium into a fluid is characterized in that the powdery medium is scattered on the fluid surface in metered form.

A mixing system according to the invention for mixing a drilling fluid includes a metering apparatus according to the invention as well as a bentonite feed operatively connected with the metering device of the metering apparatus, a water feed operatively connected with the guide device of the metering apparatus according to the invention, as well as a pump.

Preferably, the pump of the mixing system according to the invention may be a high-pressure pump, enabling the construction of a continuous flow mixing system, because a high pressure pump generates a pressure that is sufficient for transporting the drilling fluid through a hollow drill pipe.

BRIEF DESCRIPTION OF THE DRAWING

The invention will now be described in more detail with reference to exemplary embodiments illustrated in the drawings.

The drawings show in.

DETAILED DESCRIPTION OF PREFERRED EMBODIMENTS

Figure 1:
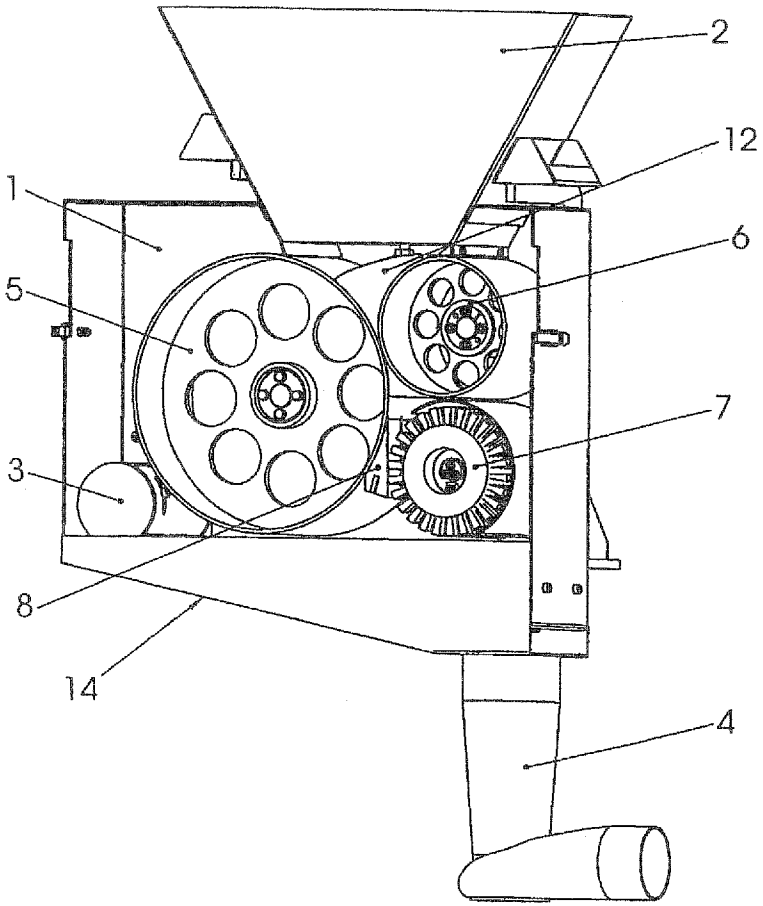
FIG. 1 in an isometric view, the front side of a metering apparatus according to the invention in a first embodiment.

FIG. 1 shows a first embodiment of a metering apparatus according to the invention in an isometric view. The metering apparatus includes a housing 1, a funnel 2 for a powdery medium, in particular a bentonite, detachably connected with the housing 1, a water inlet 3 and a mixed material outlet 4.

The housing 1 which is accessible, as illustrated in FIG. 1, by disassembling a side wall, surrounds the individual elements of the metering device of the metering apparatus according to the invention. The metering device includes a large metering roller (transport roller 5), a small metering roller 6, a brush roller 7 and a stripper 8. The transport roller 5 and the smaller metering roller 6 are positioned with respect to each other so as to form a small gap therebetween. A side face of the stripper 8 adapted to the shape of the envelope of the transport roller rests against the transport roller and is otherwise wedge-shaped. The brush roller 7 is arranged such that the tips of the brushes contact a section of the stripper 8.

Figure 2:
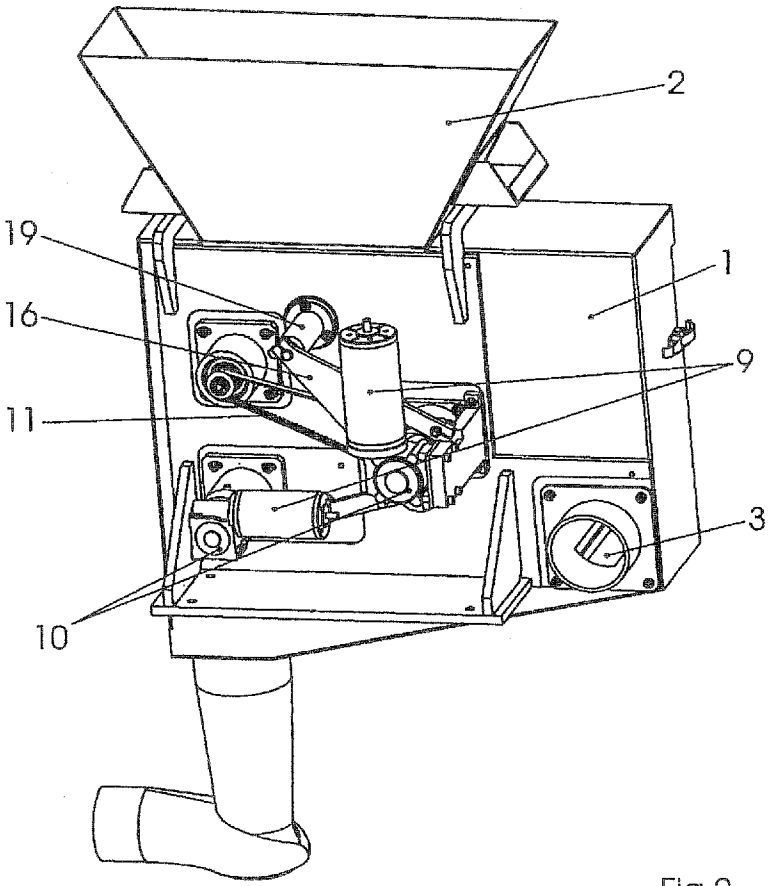
FIG. 2 in an isometric view, the rear side of the metering apparatus of FIG. 1.

The transport roller 5, the metering roller 6 and the brush roller 7 are connected via drive shafts with electric drives that are flanged to the rear side of the housing 1 (see FIG. 2). The electric drives each include an electric motor 9 and a gear 10 for imparting a rotation on the transport roller 5, the metering roller 6 and the brush roller 7. The transport roller 5 and the metering roller 6 share an electric drive which operates on the driveshaft of the transport roller 5. The drive power of this electric drive is partially transmitted from the driveshaft of the transport roller 5 by way of a toothed belt 11 to the drive shaft of the metering roller 6. The transport roller 5 and the metering roller 6 then have identical rotation directions.

The metering apparatus illustrated in FIG. 1 operates as follows: the powdery medium (bentonite) is stored in the funnel 2 and fed to the metering device arranged in the housing 1 through a metering opening disposed in the bottom of the funnel. The bentonite powder thereby drops into an intermediate space 12 which is delimited, on one hand, by the upper halves of the transport roller 5 and the metering roller 6 and, on the other hand, by the sidewalls of the housing 1. The bentonite powder is temporarily stored in this intermediate space 12. A small quantity of the temporarily stored bentonite powder is transported onward with the transport roller 5 through the gap formed between the transport roller 5 and the metering roller 6. This occurs in form of a bentonite film forming on the surface of the transport roller 5, with the thickness of the formed film corresponding approximately to the thickness of the gap between the transport roller 5 and the metering roller 6. The bentonite film is detached again from the surface of the transport roller 5 below the gap formed by the transport roller 5 and to metering roller 6 by using the wedge-shaped stripper 8, whereafter the bentonite powder is captured by the brushes of the brush roller 7 and accelerated towards the bottom side of the housing 1. The brush roller 7 thus causes substantial separation of the particles of the powdery bentonite, whereby the bentonite is scattered onto the surface of a water film flowing below.

Figure 6:
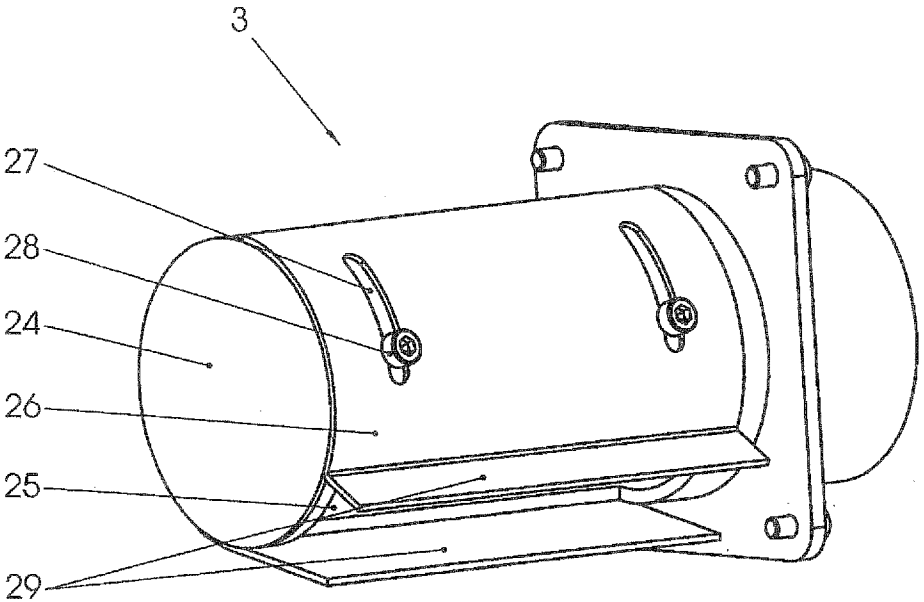
FIG. 6 in an isometric view, a detailed view of the water inlet of the metering apparatus according to FIG. 1.

For forming the water film, the water (or another fluid to be mixed with the powdery medium) is discharged through the water inlet 3 and a slit-shaped outlet opening 25 formed in the water inlet 3 (see FIG. 6). The slit-shaped metering opening 13 has a width that substantially corresponds to the interior width of the housing 1. The water then flows along the surface of the inclined bottom plate 14 of the housing 1; the water is hereby mixed with the bentonite powder according to the invention. The bentonite-water mixture is then discharged from the metering apparatus through the mixed material outlet 4.

FIGS. 3 to 6 show the structural details of several components of the metering apparatus according to FIG. 1.

Figure 3:
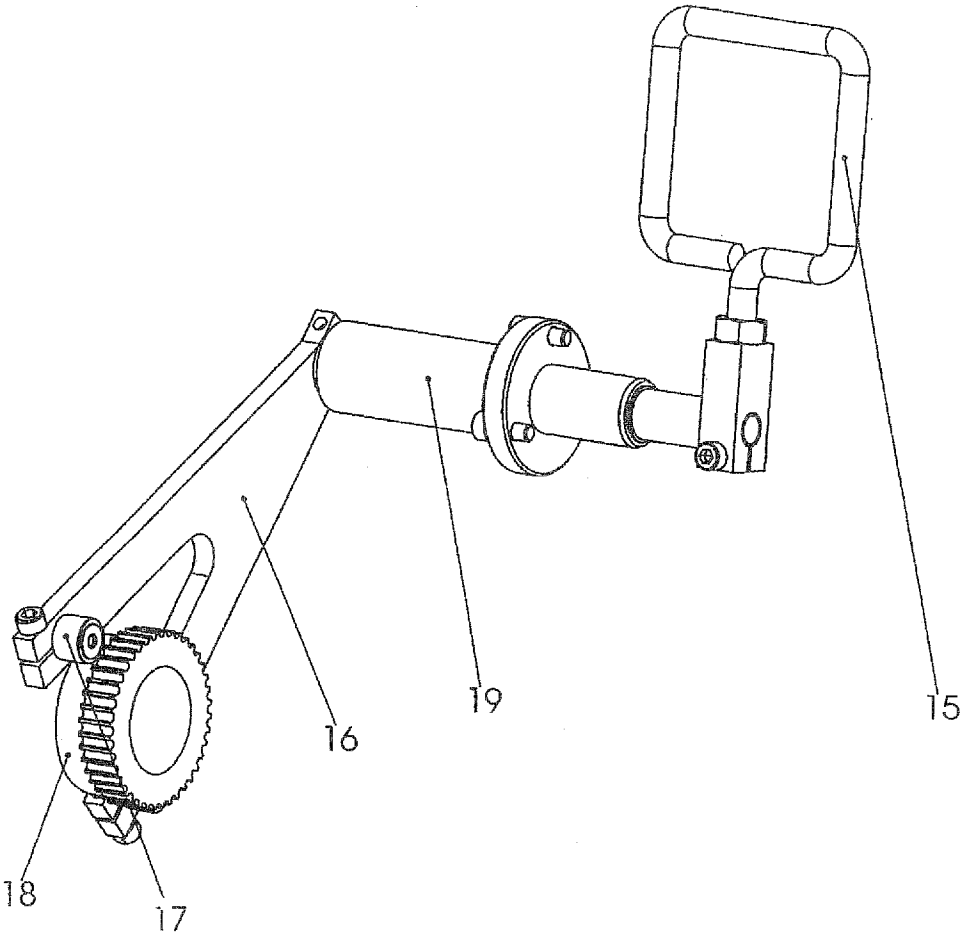
FIG. 3 in an isometric view, a detailed view of a mixing swing arm used with the metering apparatus according to FIG. 1.

FIG. 3 shows the individual elements of a mixing swing arm used with the metering apparatus according to FIG. 1. The mixing swing arm has a rectangular mixing element 15 made of a wire, which substantially prevents bridge or chimney formation of the bentonite powder in the funnel 2 through a cyclical pivoting motion inside the funnel 2. The cyclical pivoting motion of the mixing element 15 is implemented with an eccentric drive. The eccentric drive includes a Y-shaped swing arm 16 having two fingers which cooperate by way of an adjustable roller 17 with an excenter ring 18 which is in turn connected with the driveshaft of the transport roller 5. An eccentric segment of the excenter ring 18 operates alternatingly with a phase shift of 180° on a respective one of the adjustable rollers 17 of the fingers of the swing arm 16, causing alternatingly deflection of the swing arm 16 in both directions in the course of one revolution of the excenter ring 18 or the driveshaft of the transport roller 5. The cyclical deflection of the swing arm 16 is transmitted to the mixing element 15 via a swing shaft 19.

Figure 5:
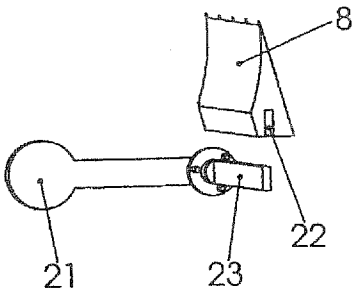
FIG. 5 the stripper of FIG. 4 in a disassembled state.
Figure 4:
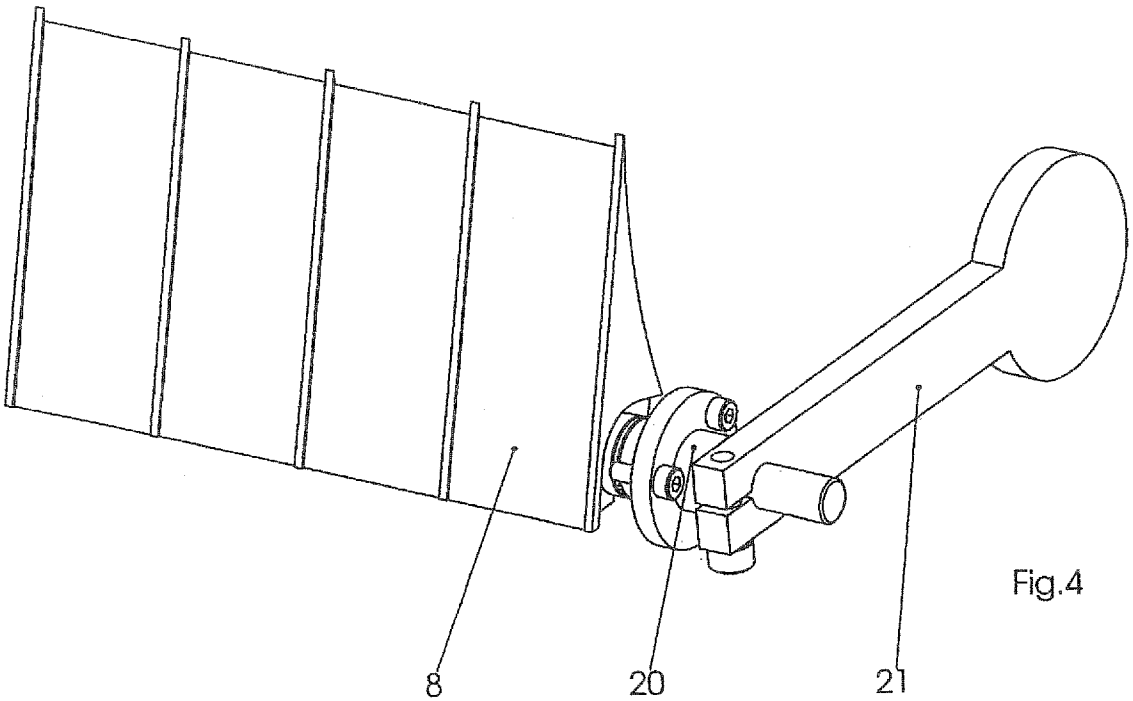
FIG. 4 in an isometric view, a detailed view of the stripper used with the metering apparatus according to FIG. 1.

FIGS. 4 and 5 show details of the stripping device of the metering apparatus according to FIG. 1. The wedge-shaped stripper 8 is connected by way of a shaft 20 with a lever 21 which due to its weight produces a torque about the shaft 20; the wedge-shaped stripper 8 is thereby pressed with a substantially constant pressing force against the transport roller 5. The wedge-shaped stripper 8 is subjected to increased wear due to the direct contact with the rotating transport roller 5. To cause mainly the wedge-shaped stripper 8 and not the transport roller 5 to be worn down, the stripper 8 is preferably made of plastic, whereas the transport roller may be made of steel. A potentially required exchange of the wedge-shaped stripper 8 due to wear may be performed without using a tool by way of a simple plug connection, as illustrated in FIG. 5. To this end, the stripper 8 has a groove 22 and can be placed on a corresponding spring element 23 (with a rectangular cross section) connected with the shaft 20. To prevent unintentional detachment of the stripper 8, the connection between the stripper 8 and the spring element 23 may be formed as a clamping (force-locked) connection.

Figure 7A:
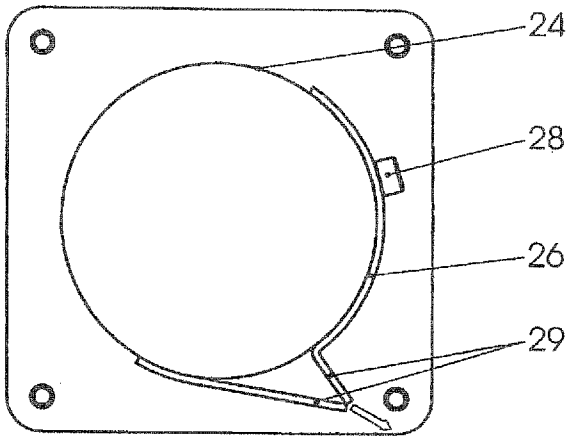
FIG. 7*a* in a side view, the water inlet of FIG. 6 in a first operating position.
Figure 7B:
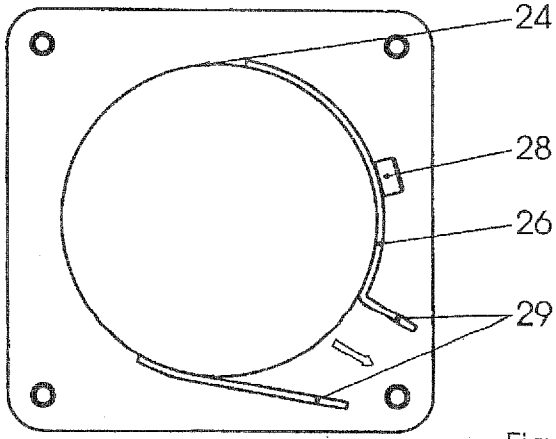
FIG. 7*b* in a side view, the water inlet of FIG. 6 in a second operating position.

FIG. 6 shows the details of the water inlet 3 of the metering apparatus according to FIG. 1 in an isometric view. The water inlet 3 includes a tube 24 which is closed off on one side and extends with the closed end into the housing 1. In the section extending into the housing 1, the tube 24 has a slit-shaped outlet opening 25, wherein the width of the outlet opening 25 can be varied with a closure element 26 that is movable on the tube in the circumferential direction. To this end, the closure element 26 has two longitudinal openings 27, with two screws 28 connected with the tube 24 extending through the openings 27. The closure element 26 can be moved relative to the tube 24 within the limits defined by the size of the longitudinal openings 27, allowing the width of the outlet opening 25 to be varied. The tube 24 and the closure element 26 are each provided with a guide plate 29 for deflecting the flow of the exiting water into the desired direction. FIG. 7*a* shows a position of the closure element 26 wherein the width of the slit-shaped outlet opening 25 is very small, allowing only a small amount of water to be discharged (small arrow). Conversely, FIG. 7*b* shows a position of the closure element 26 with a wide outlet opening 25 and consequently greater water discharge (large arrow). Alternative to the manual adjustment, the closure element 26 may also be adjusted, for example, electrically, electromagnetically, pneumatically and/or hydraulically, wherein the adjustment may be initiated manually or may occur automatically, depending on the required quantity of water.

Figure 8:
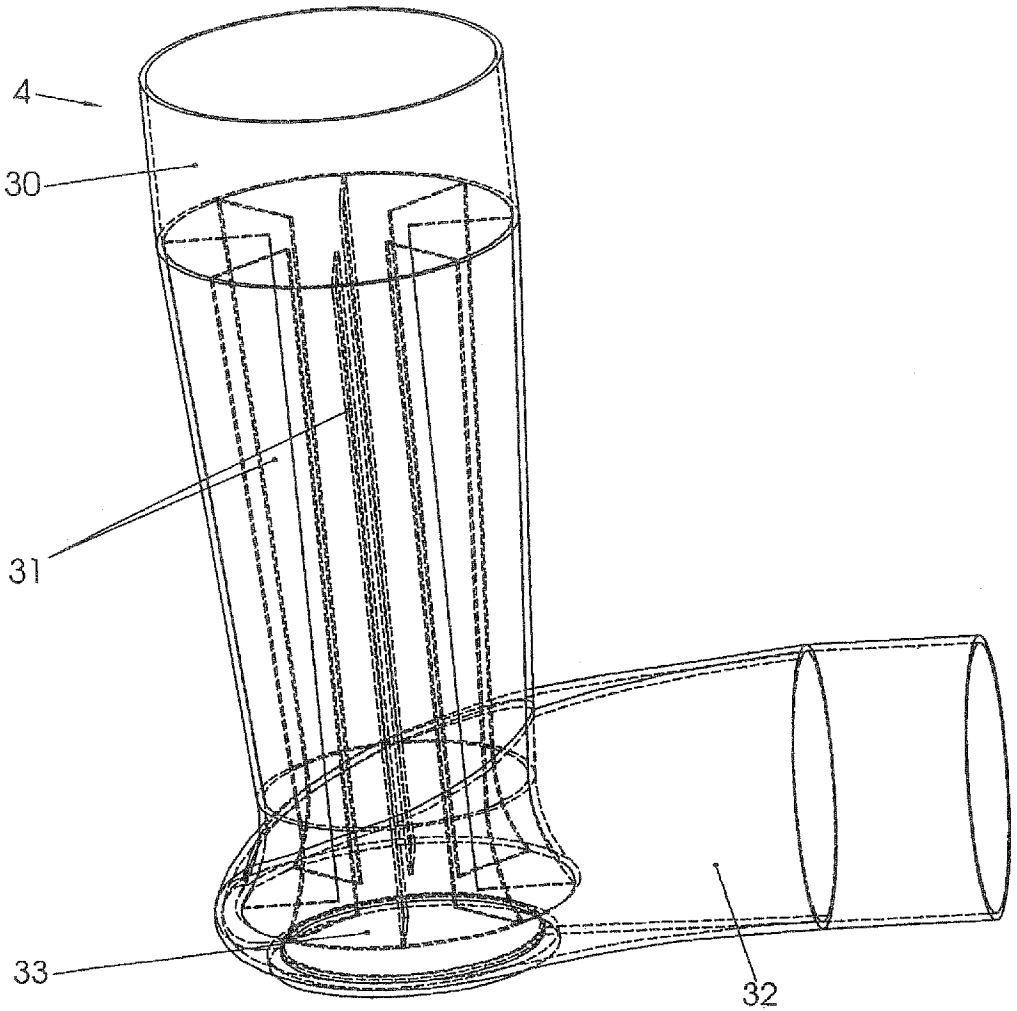
FIG. 8 in an isometric view, a detailed view of the mixed material outlet of the metering apparatus according to FIG. 1.

FIG. 8 shows the mixed material outlet 4 through which the mixed material, i.e., the bentonite-water-mixture, is discharged from the metering apparatus. The mixed material outlet 4 includes a substantially vertical tube 30 (in the operating position of the metering apparatus illustrated in FIG. 1), wherein a total of eight guide plates 31 which are oriented in the longitudinal direction of the first tube are arranged on the interior side of the tube 30. The bentonite-water mixture entering the mixed material outlet 4 from above flows downward along the guide plates 31 through the first tube 30, where it enters in a second, substantially horizontal tube 32 (in the operating position of the metering apparatus illustrated in FIG. 1) of the mixed material discharge 4. A calming zone 33 for the mixture is thereby formed in the region of the transition from the first tube 30 to the second tube 32. The configuration of the mixed material outlet 4 with the guide plates 31 arranged inside the first tube 30 and of the calming zone 33 at the transition from the first tube 30 to the second tube 32 produces a substantially bubble-free bentonite-water mixture.

Figure 9:
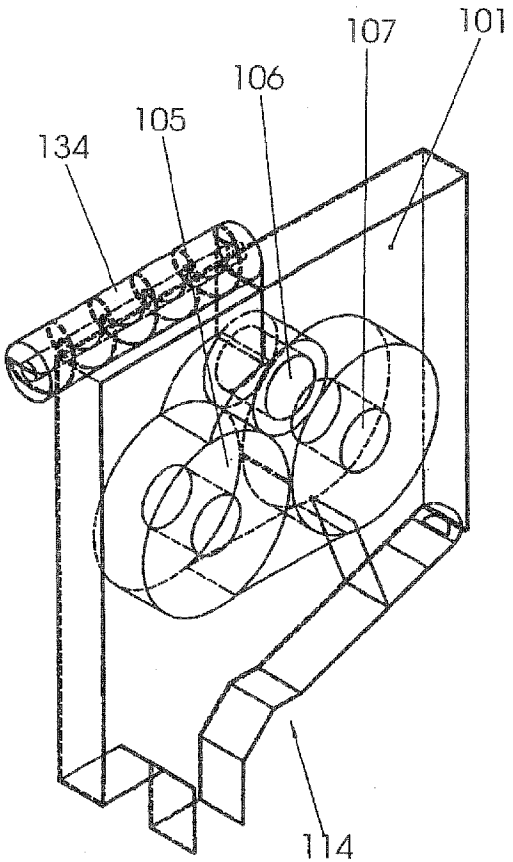
FIG. 9 in an isometric view, a metering apparatus according to the invention in a second embodiment.

FIG. 9 shows an alternative embodiment of a metering apparatus according to the invention. This metering apparatus corresponds in principle substantially to the metering apparatus of FIG. 1, and therefore has a transport roller 105, a metering roller 106 and a brush roller 107 which are arranged inside a closed a housing 101 and are driven by electric drives. Unlike the metering apparatus of FIG. 1, the embodiment according to FIG. 9 does not include a funnel for storing the bentonite powder and introducing the bentonite powder into the metering device in metered form; instead, the metered bentonite powder is fed with a metering screw 134. FIG. 9 shows clearly the formation of the very thin water film on the top side of the inclined bottom plate 114 of the housing.

Figure 10:
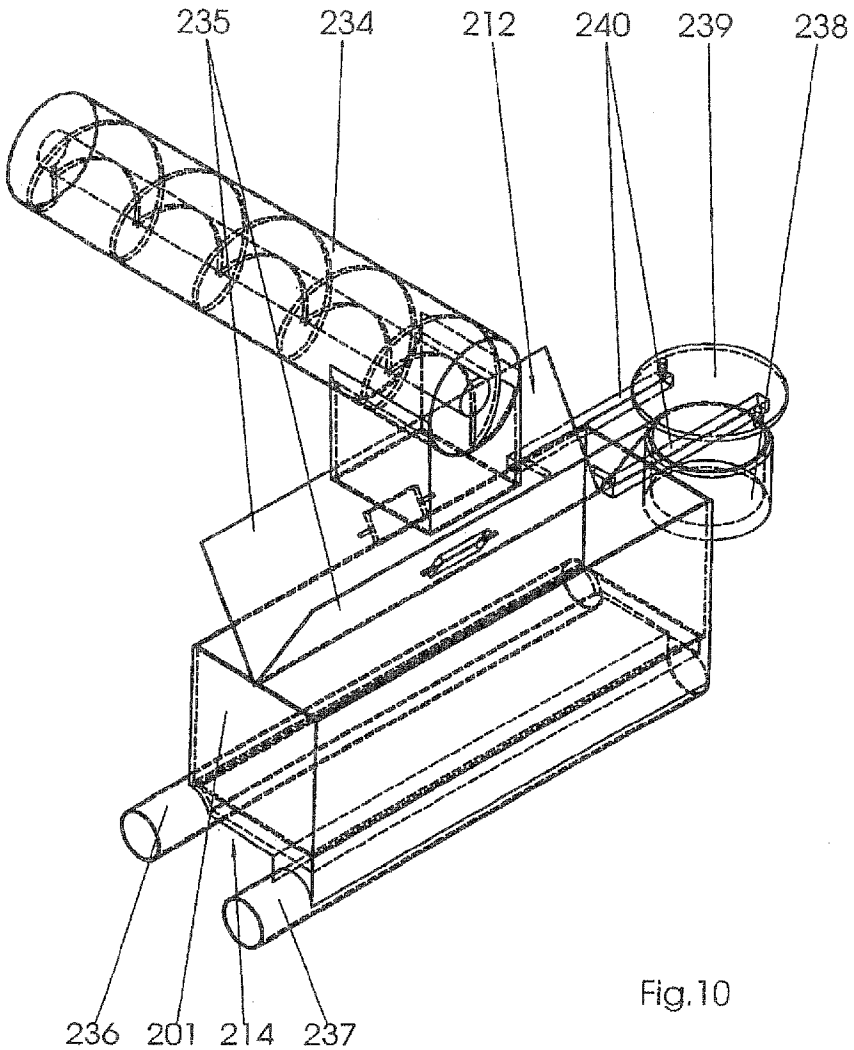
FIG. 10 in an isometric view, a metering apparatus according to the invention in a third embodiment.

FIG. 10 shows another alternative embodiment of a metering apparatus according to the invention, wherein the particles of the bentonite powder are separated based on a principle that is different from the principle of the metering apparatuses according to FIG. 1 and FIG. 9. Like in the metering apparatus according to FIG. 9, the bentonite powder in the metering apparatus according to FIG. 10 is fed with a metering screw 134, whereafter the bentonite powder drops into an intermediate space 212 with a tapered-down cross-section, where the bentonite powder is temporarily stored. The intermediate space 212 is formed by two (angled) metering plates 235 which are inclined relative to each other, with the lower edges of the to metering plates 235 forming a narrow gap through which the bentonite powder trickles (i.e., is scattered) on the water film flowing below (according to the principle of an hourglass).

For forming the water film, the water is fed via an inlet tube 236 having an (unillustrated) slit-shaped opening and a width that corresponds substantially to the width of the housing 201 of the metering apparatus. The inlet tube 236 may, like the water inlet 3 of FIG. 1 or FIG. 6, include an adjustable opening. The water exiting the slit-shaped opening flows in form of a thin film along the inclined bottom plate 214 of the housing 201 where it is mixed with the bentonite powder falling down from the metering unit. The bentonite-water mixture is then discharged from the metering apparatus through an outlet tube 237.

To support a continuous discharge of the bentonite powder through the gap formed by the metering plates 235, the two metering plates 235 are moved cyclically relative to one another (with opposite phases), as shown in FIG. 10 by the arrows. The movement directions of the two metering plates 235 are parallel to the gap formed by the metering plates 235. The cyclical movements of the metering plates 235 are generated by an electric motor 238 which is connected with the respective metering plate 235 by way of a drive disk 239 and a plunger 240 which is eccentrically mounted on this drive disk.

The structural and functional details of the aforedescribed exemplary embodiments cannot only be applied in the respective actually disclosed combination, but can be applied in any combination also with other embodiments according to the invention.

What is claimed is:

1. A metering apparatus for producing a powdery medium on a surface of a free-flowing fluid, comprising:

a housing having an inclined bottom plate, on which the fluid flows under the effect of gravity, a guide device for guiding the fluid and forming a continuous flow of the fluid in the housing, wherein a width of the fluid film is a multiple of a depth of the fluid film, and a metering device arranged above the guide device and dispensing the powdery medium, the metering device constructed to scatter the powdery medium onto the fluid surface, said metering device comprising a first metering roller and a cooperating counter element defining a metering gap having a width which corresponds substantially to the width of the guide device, and a roller-shaped metering brush separating lumped particles of the powdery medium exiting the metering device.

2. The metering apparatus of claim 1, wherein the counter element is constructed as a second metering roller.

3. The metering apparatus of claim 2, wherein the first metering roller and the second metering roller are driven to rotate in an identical rotation direction.

4. The metering apparatus of claim 1, wherein the metering device includes two opposing plates having a conical arrangement, with the metering gap being formed by the two opposing plates.

5. The metering apparatus of claim 4, wherein the plates are configured for cyclically movement with respect to one another.

6. The metering apparatus of claim 1, further comprising a feed screw for supplying the powdery medium to the metering device.

7. The metering apparatus of claim 1, wherein the powdery medium comprises bentonite and the fluid is an aqueous fluid.

8. A method for introducing a powdery medium into a free-flowing fluid, comprising the steps of:

providing inside a housing a continuous flow of the fluid, wherein the fluid flows freely on an inclined bottom plate under the effect of gravity, metering the powdery medium with a metering device having a predetermined metering gap, separating lumped particles of the powdery medium exiting the metering device with a roller-shaped metering brush, and scattering the separated metered powdery medium onto the fluid surface of the free-flowing fluid by gravity.

9. A mixing system for mixing a drilling fluid, comprising:

a metering apparatus comprising a housing having an inclined bottom plate, on which the fluid flows under the effect of gravity, a guide device for guiding the fluid and forming a continuous flow of the fluid in the housing, wherein a width of the fluid film is a multiple of a depth of the fluid film, and a metering device arranged above the guide device and dispensing the powdery , the metering device constructed to scatter the powdery medium onto the fluid surface, said metering device comprising a first metering roller and a cooperating counter element defining a metering gap having, a width which corresponds substantially to the width of the guide device, and a roller-shaped metering brush separating lumped particles of the powdery medium exiting the metering device a bentonite feed operatively connected with the metering device, a water feed operatively connected with the guide device, and a pump.

10. The mixing system of claim 9, wherein the pump comprises a high-pressure pump.

* * * * *

UNITED STATES PATENT AND TRADEMARK OFFICE

CERTIFICATE OF CORRECTION

PATENT NO. : 8,753,001 B2
APPLICATION NO. : 13/375323
DATED : June 17, 2014
INVENTOR(S) : Manfred Schauerte et al.

It is certified that error appears in the above-identified patent and that said Letters Patent is hereby corrected as shown below:

In the Claims:

Column 8, line 59, Claim 9: Please add -- medium -- after “powdery”.

Column 8, line 67, Claim 9: Please add -- , -- after “device”.

Signed and Sealed this
Seventh Day of October, 2014

Michelle K. Lee

Michelle K. Lee
*Deputy Director of the United States Patent and Trademark Office*